United States Patent [19]

Van Ornum

[11] Patent Number: 4,741,365

[45] Date of Patent: May 3, 1988

[54] COMPOUND PNEUMATIC VALVE

[75] Inventor: Charles A. Van Ornum, Fountain Valley, Calif.

[73] Assignee: McDonnell Douglas Corporation, Long Beach, Calif.

[21] Appl. No.: 892,303

[22] Filed: Aug. 4, 1986

[51] Int. Cl.[4] ..... F15B 13/044

[52] U.S. Cl. ..... 137/625.65; 137/625.69; 251/129.05; 129.1/129.16

[58] Field of Search ..... 137/625.65, 625.3, 625.69; 251/129.05, 129.1, 129.16

[56] References Cited

U.S. PATENT DOCUMENTS

| | | | |
|---|---|---|---|
| Re. 32,035 | 11/1985 | Kuroiwa et al. | 123/490 X |
| 1,518,894 | 12/1924 | Bliss . | |
| 2,967,545 | 1/1961 | Schmidt . | |
| 3,144,047 | 8/1964 | Tjaden | 251/129.16 X |
| 3,466,003 | 9/1969 | Boonshaft et al. | 137/625.65 X |
| 3,661,183 | 5/1972 | Komaroff et al. | 137/625.65 |
| 3,774,642 | 11/1973 | Gray | 137/625.65 |
| 3,874,407 | 4/1975 | Griswold | 251/129.05 X |
| 4,182,375 | 1/1980 | Fukano et al. | 137/625.65 X |
| 4,353,394 | 10/1982 | Loup . | |
| 4,396,037 | 8/1983 | Wilcox . | |
| 4,422,475 | 12/1983 | Aspinwall | 137/625.65 |
| 4,456,434 | 6/1984 | El Ibiary | 137/625.65 X |
| 4,538,645 | 9/1985 | Perach | 137/625.65 |
| 4,556,085 | 12/1985 | Warrick | 137/625.65 |
| 4,570,904 | 2/1986 | Mullally | 137/625.65 X |
| 4,583,710 | 4/1986 | Adams et al. | 251/129.1 |
| 4,611,632 | 9/1986 | Kolchinsky et al. | 137/625.65 |
| 4,624,285 | 11/1986 | Perach | 137/625.65 |

FOREIGN PATENT DOCUMENTS

| | | |
|---|---|---|
| 1324456 | 7/1973 | United Kingdom . |

*Primary Examiner*—Gerald A. Michalsky
*Attorney, Agent, or Firm*—Paul T. Loef; George W. Finch; John P. Scholl

[57] ABSTRACT

A compound pneumatic valve of the bang-bang, spool type; electro-mechanically driven by a pair of face type opposing solenoids which in turn are driven by a pulse width modulator signal. First and second cylinder parts are alternately pressurized and vented through asymmetrical slot style ports to function in the two horsepower range having bandwidths of 30 to 45 Hz.

11 Claims, 5 Drawing Sheets

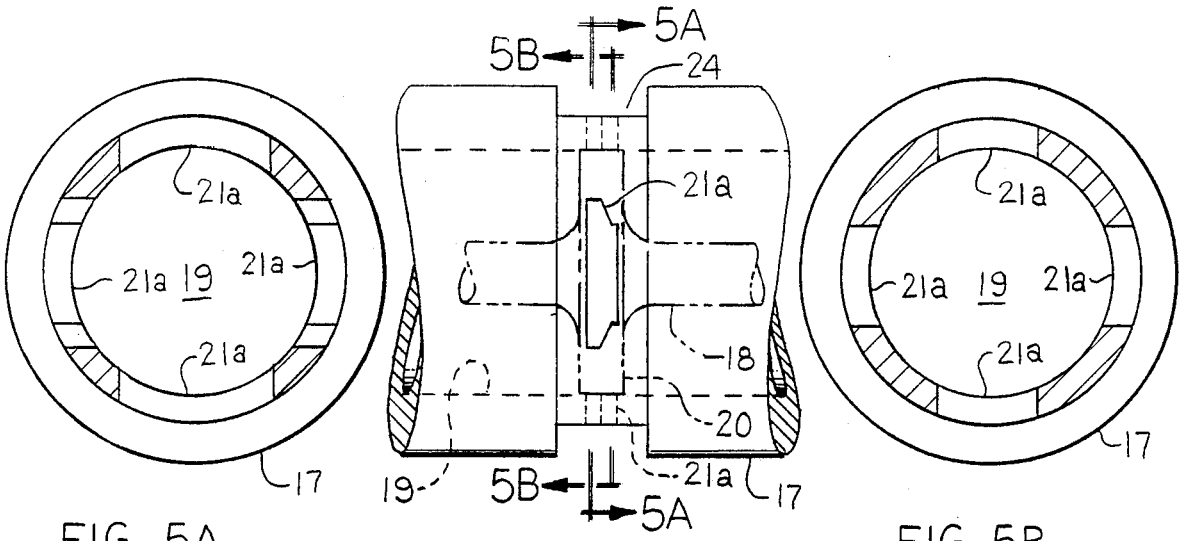
FIG. 5A
FIG. 5
FIG. 5B
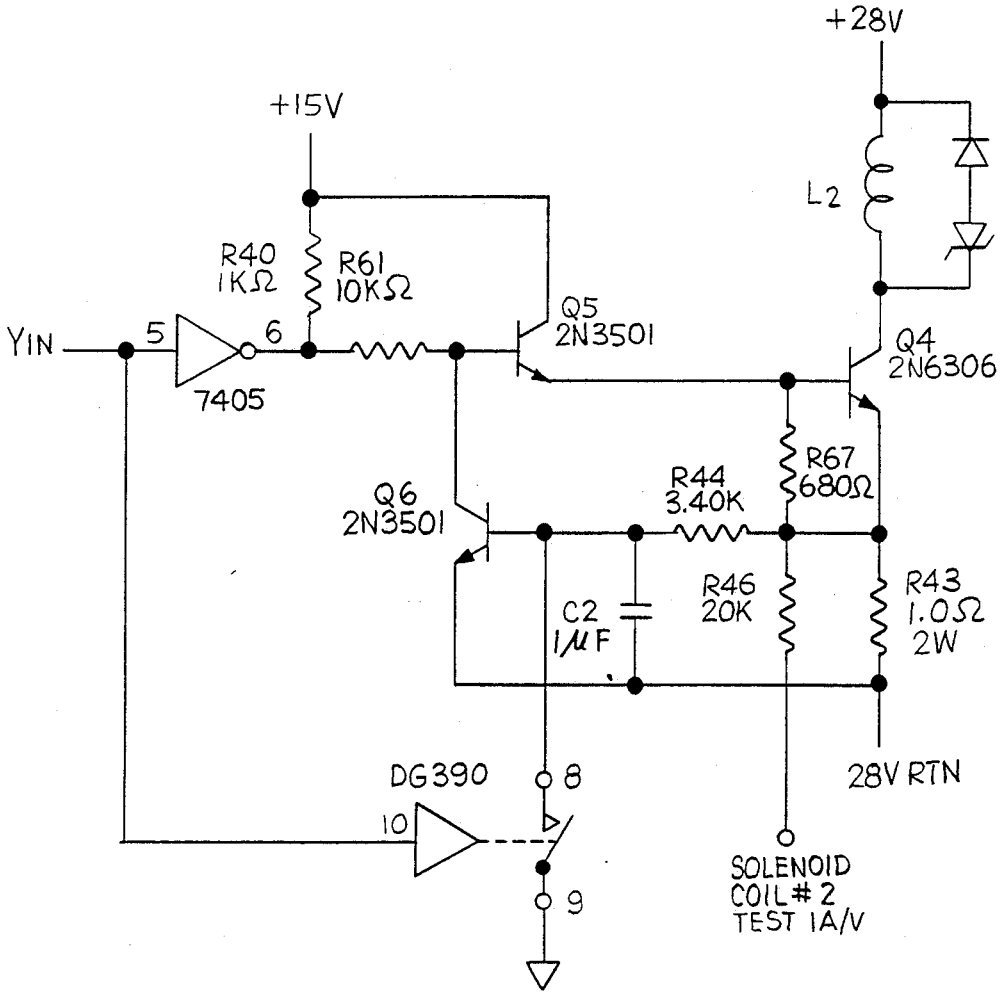
FIG. 6

TIME DELAYED CURRENT LIMITING OF PULSE WIDTH MODULATED SOLENOID

COMPOUND PNEUMATIC VALVE

BACKGROUND OF THE INVENTION

This invention relates to missile control systems and more particularly to electro-pneumatic control valves for controlling the actuators which drive generally, either missile control surfaces or gimbaled motor nozzles.

All missiles and space vehicles use control systems to change the vehicle's flight path. Typically, they use actuators that rotate aerodynamic control fins or, alternately, that rotate gimbaled thrust vector control nozzles. Typically, the actuators are driven by electrical, hydraulic, or pneumatic power. Studies show cold gas-powered actuators to be superior in cost, weight, size and complexity to the other alternatives for actuation of tactical missile control fins and motor nozzles. However, prior art pneumatic actuator bandwidth has typically ranged from 15 to 25 Hz for applications requiring 0.5 to 2.0 horsepower, while new tactical missile applications require bandwidths in the 30 to 45 Hz range.

Generally there are unbalanced piston actuator systems and balanced piston actuator systems as shown in FIGS. 1 and 2 respectively. An examination of FIGS. 1 and 2 shows that the unbalanced piston actuator scheme required two valves to drive the single fin, whiel the balanced piston actuator required 4 valves. Typically, the valves employed were solenoid-operated poppet valves which are not pressure-balanced and thus require an increased solenoid force-stroke product with increasing actuating horsepower. The result is a degradation of valve response and actuator bandwidth with increasing horsepower. Typically, 16 control solenoids and drive electronic circuits were required per missile to drive the balanced piston scheme, which clearly raises questions about control system reliability. In contrast, the unbalanced piston system required only 8 solenoids and drive circuits per missile. It is important to note that the balanced piston actuator is inherently four times stiffer than the unbalanced piston actuator and capable of twice the horsepower for comparable actuator size.

Attempts to exploit the advantages of the balanced piston actuator to date have met with only modest success, one of the reasons being the requirement of 16 control solenoids and drive circuits when using the solenoid-operated poppet valves, as discussed. Clearly there have been attempts to replace the poppet valves with compound valves, although the fluid medium has been hydraulic rather than pneumatic. The NIKE missile, designed and manufactured by the assignee of this invention, was an early attempt to use a direct drive, solenoid actuated, compound valve. At first blush and in principal, it would appear quite similar to the valve of this invention except that it was a 4-way, 4-land hydraulic valve. The valve was not very producible and required extensive customizing and bench tuning of each valve. No known compound pneumatic valves have been developed which function in the 0.5 to 2.0 horsepower range having bandwidths of 30 to 45 Hz.

It is an object of the present invention to provide a compound pneumatic valve for operation with a balanced actuator capable of controlling up to 2 horsepower with a bandwidth of 30–45 Hz for driving a missile control surface or motor nozzle with no increase in the number of control solenoids and electrical drive circuits required for an unbalanced actuator scheme.

It is a further object of the present invention to provide a compound pneumatic valve which maintains essentially constant bandwidth with increasing horsepower.

A still further object of this invention is to provide a valve which can be scaled to accommodate a range of flows or what might be referred to as horsepower without big changes in the valve configuration while maintaining response characteristics and thereby avoiding degradation in bandwidth.

SUMMARY OF THE INVENTION

In summary, the above objectives are accomplished by providing a high power, pneumatic, bang-bang, spool type valve electro-mechanically driven by a pair of opposing solenoids which in turn are driven by a pulse width modulated (PWM) input signal. The valve is best suited for driving a balanced actuator in the 30–45 Hz bandwidth region. The valve has an inlet port, a vent port and first and second load or cylinder ports which are alternately pressured and vented by a flow spool with a closed center position. Two enlarged lands oriented to cover the first and second load or cylinder ports when the spool is in the center or closed position are features of the valve. Because of the very short stroke (0.003 to 0.005 inches) between the spool center position and full open, in either direction, the valve flow or horsepower rating is controlled by adjusting or altering the diameter of the lands. The solenoids use flat faced armatures and a core design that keeps the magnetic flux path removed from the longitudinal center line of the spool so as to minimize eddy currents. Adjustable biasing means are provided to center the spool in the closed position in the absence of a pulsed signal, and the biasing means applies no force when the spool is in the closed or center position and an essentially constant force when the spool is displaced. Centering of the spool is further aided by the Bernoulli forces inherently centering the spool in a compound valve. Since linearity is produced by controlling the width of the pulse width modulated signal, non-linear solenoids may be used to produce a high net force authority which increases as the spool stroke increases.

As the flow spool is inherently pressure-balanced, the spool diameter (and hence, horsepower capacity) can be doubled without significantly altering valve response using the same solenoids. This is possible because the solenoid air gap does not change with the doubling of the horsepower. The increase in spool inertia as a result of increasing the diameter of the two spool lands is small in relationship to the large diameter of the armatures which represent the major portion of the moving mass. The increased Bernoulli force as a result of doubling the spool diameter is still only a small effect and can be compensated for by adjusting the spool's centering biasing means.

BRIEF DESCRIPTION OF THE DRAWINGS

With reference to the drawings, wherein like reference numerals designate like portions of the invention:

FIG. 5 shows a detail of the asymmetric spool slots;

FIG. 5A shows a section view of the asymmetrical spool slot of FIG. 5 in one direction;

FIG. 5B shows another section view of the asymmetrical spool slot of FIG. 5 in the opposite direction from FIG. 5A;

FIG. 6 shows a possible time delay, current limiting power amplifier circuit for energizing a solenoid;

DETAILED DESCRIPTION OF THE PREFERRED EMBODIMENT

Figure 11:
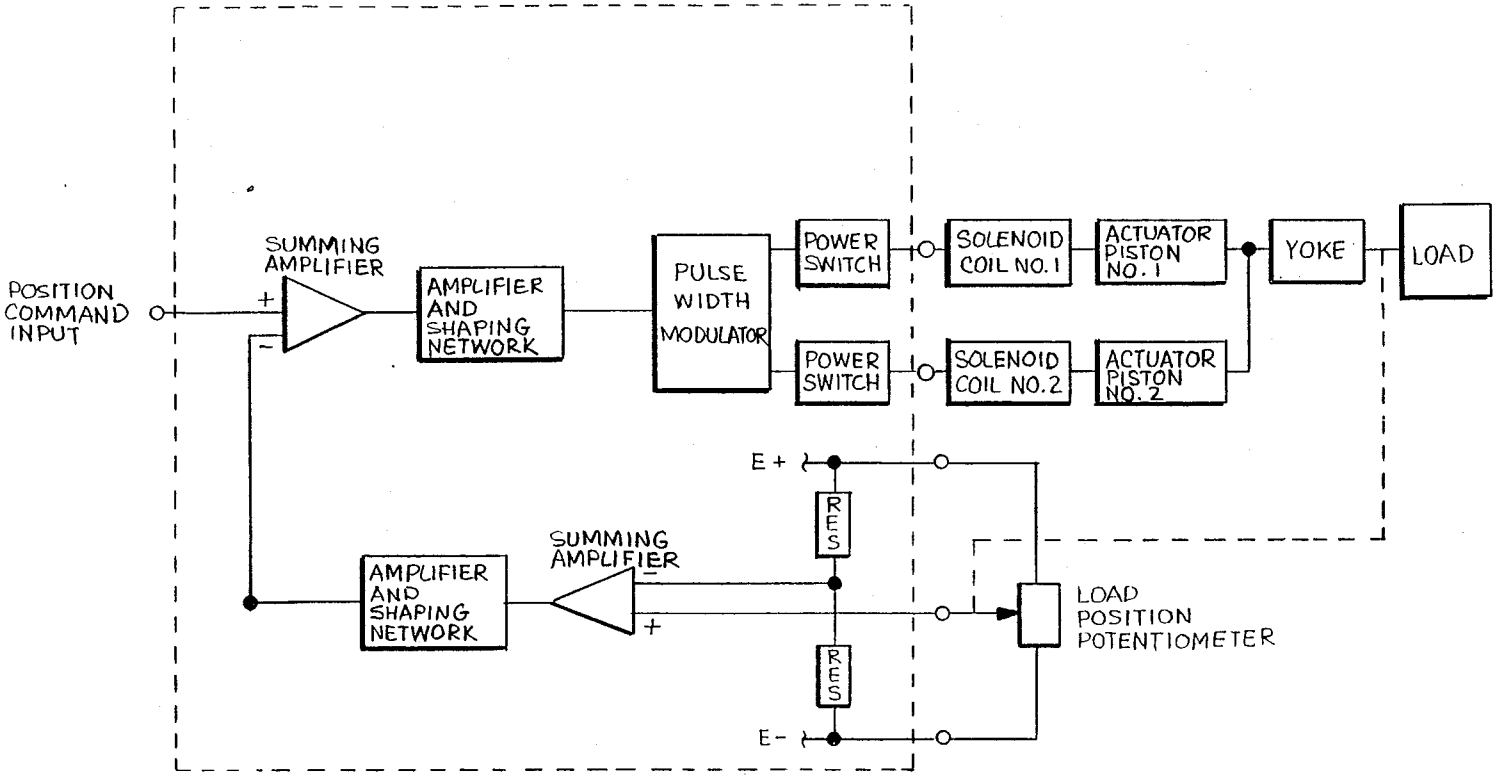
FIG. 11 is a simplified functional block diagram of the servo system in accordance with the invention.

A single line, single channel, functional diagram of the subject of this invention is shown in FIG. 11. The 'load' block represents whatever means are used to control the missile in flight, usually a fin or gimbaled nozzle. The load position potentiometer is shown mechanically connected to the load so that if the load moves, it affects the output of the potentiometer. The E+ and the E− terminals indicate a power source, e.g., a battery (not shown) imposed across the potentiometer which has a parallel leg with a resistor (res) on each side of the center null position. The center null position is combined with the output of the load position potentiometer and fed into a summing amplifier which is followed by a shaping network and may be identified as feedback signal. This feedback signal is then combined with the load position command signal and fed into the summing amplifier. The resulting error signal is next modified by a shaping network, and finally input to the pulse width modulator.

In the pulse width modulator, the shaped error signal is combined with a sawtooth signal of a predetermined frequency and run through a pair of comparators to produce the pulse width necessary to achieve the commanded rate. The pulse width modulated output is directed to one of a pair of power switches, depending upon the direction in which the load, e.g., a fin, is being directed. Included in the power switch function is a circuit which provides the time delay and current limitations (shown in FIG. 7) as well as power responsive to the pulse width modulated signal. Although a number of circuit mechanizations are available to implement time delayed current limiting and the choice is best left to those skilled in this particular art, an analog circuit which will perform this function is shown in FIG. 6. The pair of power switches directs the pulse width modulated power to either solenoid coil number 1 or coil number 2 of the spool type valve of FIG. 4 which is generally the heart of this invention.

Figure 7:
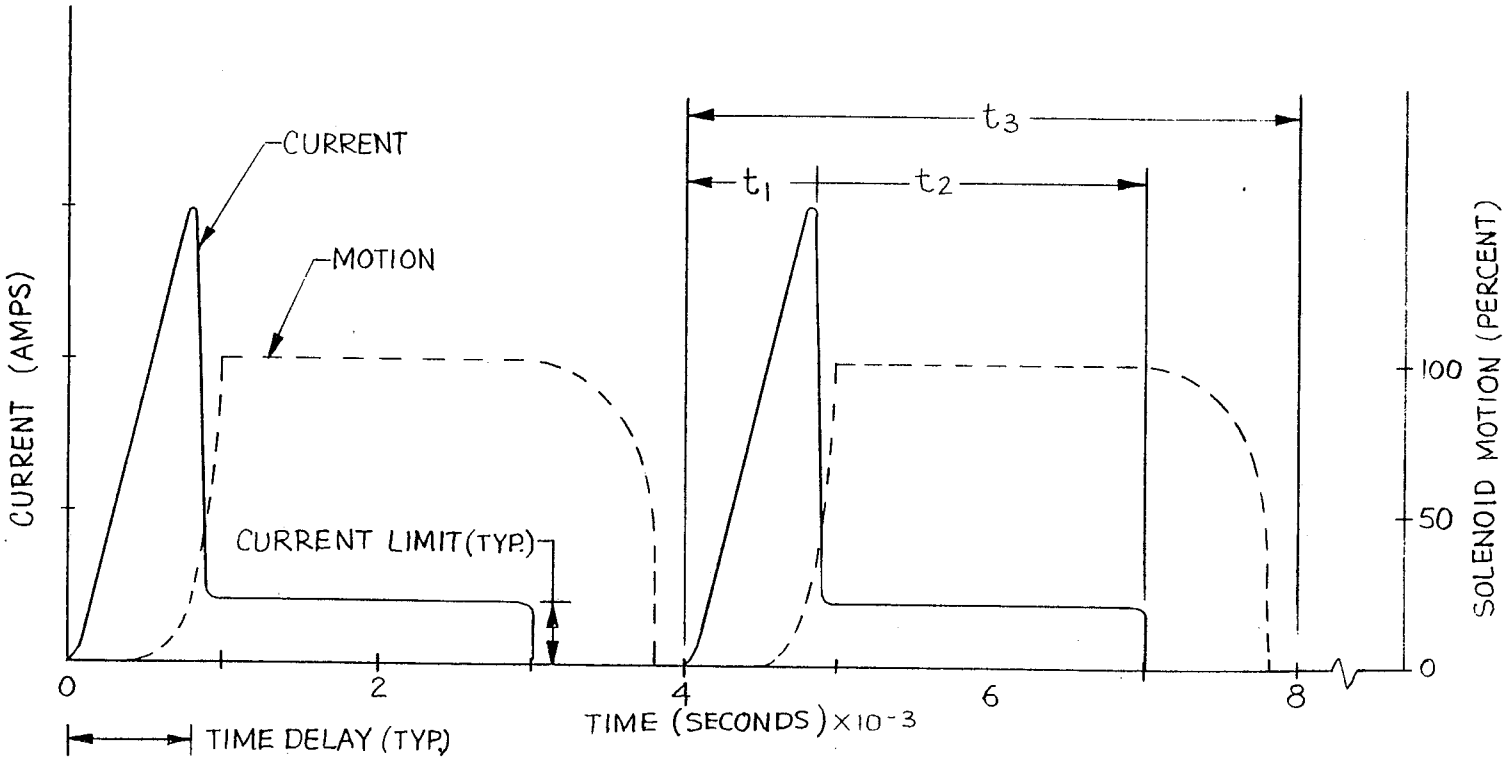
FIG. 7 shows graphically the time delay, current limiting function.

Representative current and displacement traces for the pulse-width modulated (PWM) solenoid are shown in FIG. 7, where the PWM period $t_3$ is just the reciprocal of the PWM frequency (250 Hz for the example shown). The solenoid resistance is chosen such that the steady state current without limiting would be at least an order of magnitude greater than the value reached by time $t_1$ when pull-in is well underway. This allows the current to increase essentially linearly with time during the period $t_1$, at a rate directly proportional to the applied voltage and inversely proportional to the solenoid inductance. The current rise rate is maximized during $t_1$ by applying the maximum available voltage to the solenoid, and by minimizing solenoid inductance consistent with maximizing the ampere-turn-per-second rate.

At the end of the time $t_1$, the solenoid air gap is rapidly closing, greatly reducing the number of ampere turns needed to sustain the desired solenoid force, and allowing current reduction to the limit shown without reduction of the solenoid force below the level needed to keep it in the retracted position. When solenoid drop-out is initiated at the end of the time period, $t_2$, the current reduction needed to effect release is small, thus minimizing drop-out time.

The practical current limit is typically 10–20% of the peak current. Thus FIG. 7 shows that the maximum current demand from the power source can be reduced to about 20% of the peak value by adding a reasonably sized capacitor to the power supply, so that peak demands are provided by the capacitor during the time period $t_1$, with re-charging of the capacitor during the remainder of the time period $t_3$. Also, solenoid heating is greatly reduced by time-delayed current limiting; since heating is proportional to the square of current, it is reduced after time period $t_1$ to about 2–4% of the peak value.

In summary, this time delayed, current limited approach to controlling the pulse width modulated solenoid power minimizes the solenoid drop out time, average current demand from the electrical power source, and solenoid heating.

Figure 4:
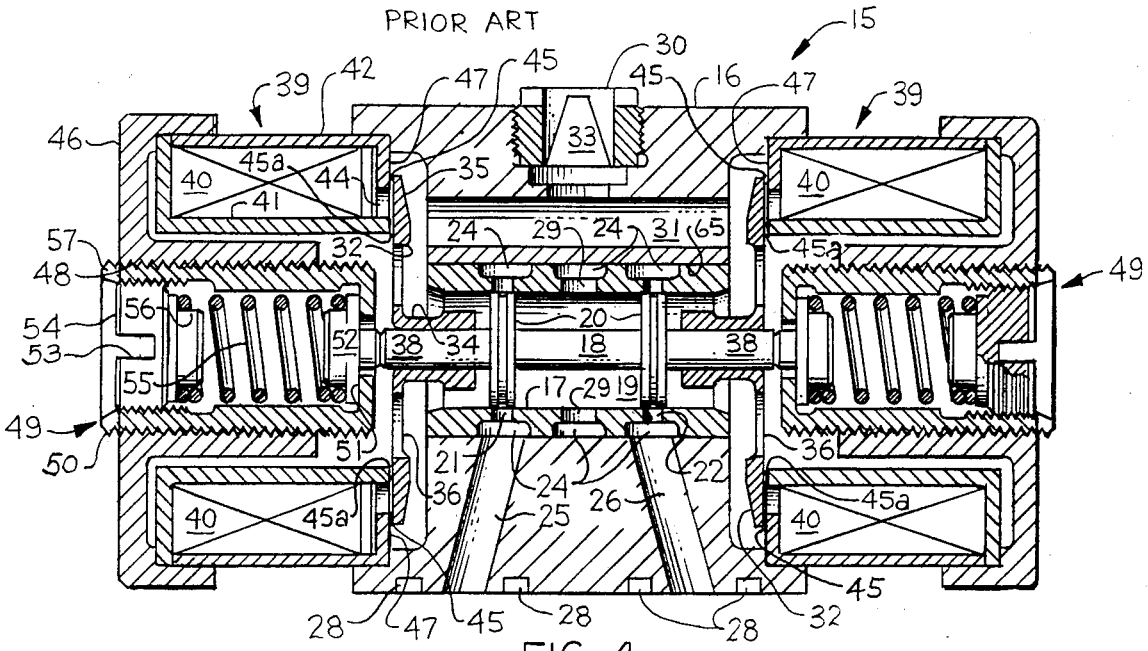
FIG. 4 shows a sectional view through the compound pneumatic valve of this invention.

Depending on which solenoid is energized, the spool of the servo valve of FIG. 4 is displaced so as to direct fluid energy to either actuator piston number 1 or number 2, which in turn drives a yoke or linkage connected to the load which, again, is usually a fin or gimbled nozzle.

Tactical missile systems not only demand a priority to response in horsepower but a linear relationship between a commanded load or fin position and the actual fin position is essential. In order to achieve these features in the overall system, the elements of the system must be selected accordingly, e.g., the balanced piston actuators are inherently four times stiffer than the unbalanced piston actuator, and are capable of twice the horsepower for comparable actuator size. The compound pneumatic valve of this invention, as shown in FIG. 4, has been specifically designed for use with the balanced piston pneumatic actuator.

Figure 1:
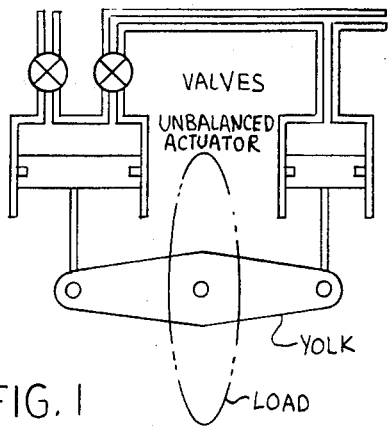
FIG. 1 PRIOR ART
FIG. 1 shows an unbalanced piston actuator scheme.
Figure 2:
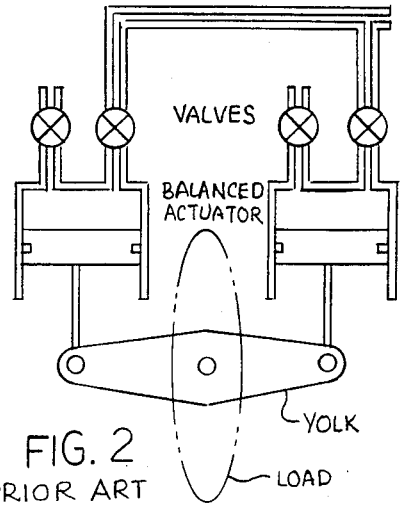
FIG. 2 PRIOR ART
FIG. 2 shows a balanced piston actuator piston scheme.
Figure 3:
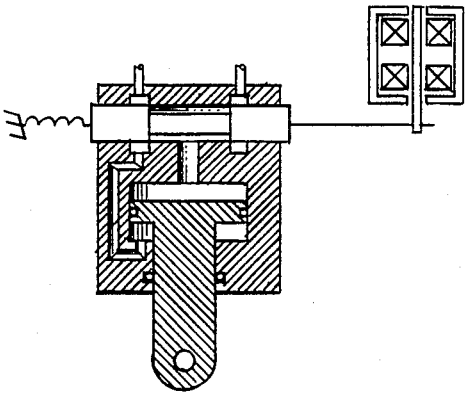
FIG. 3 PRIOR ART
FIG. 3 shows a prior art pneumatic spool valve and an unbalanced actuator with a torque motor driving the flow spool against a spring.

The idea of a valve having an electromechanically driven flow spool is not new to pneumatic actuation. However, past implementations achieved linearity, typically, either by employing a torque motor, which is inherently linear, pushing a flow spool against a spring as shown in FIG. 3, or by driving a plunger type solenoid, which is inherently slower and weaker but more linear than the flat faced solenoid, against a spool spring to produce linearity. A given single amplitude produced a force which caused the spool to move until the compressed spool spring just balanced the applied force, theoretically resulting in a linear relationship between command signal and spool displacement. However, operation was erratic in the face of spool "stiction" and friction because of the relatively low force of the torque motor or a low force margin available to overcome the stiction and friction which approached zero near full stroke command position. A key feature of the compound pneumatic valve of this invention is the use of inherently non linear solenoids to drive the spool against caged springs that produce only enough force to center the spool in the absence of commands and the net force authority actually increases as the spool advances in its stroke. The linear relationship between commanded and actual flow is achieved by modulating the width of the pulse powering the solenoid. The valve spool is either full open or full closed (bang-bang valve) and the duration of the on time is varied at high frequency to linearize the relationship between command and flow. In order to achieve successful operation the pulse width modulation period $t_3$ in FIG. 7 needs to be approximately four times the response time of the valve spool from full closed to full open. Here the response time is less than 1 ms and the pulse frequency is 250 Hz or a period of 4 ms. However, if a hard over actuator command was imposed, the valve would remain full open until the actuator was near the commanded position.

The compound pneumatic valve 15 is shown in FIG. 4, having a valve body 16 which supports a sliding spool 18 in a bore 19 of sleeve 17. Spool 18 has a pair of lands 20 oriented such that when the spool is in the center or closed position the two lands align with or cover the first and second load or cylinder ports 21 and 22. Both ports are shown with an annular relief 24 and first cylinder passage 25 and second cylinder passage 26 which are shown with annular o-ring grooves 28 for bolt on connection to the actuator. The external connections, of course, are a matter of design choice and in some cases it may be preferable to have threaded fittings. The pressure port is shown at 29 also including an annular relief 24 and the passage and external connection are not shown as they are rotated in the plane of the paper. However, pressure enters through the annular relief 24 to the port 29 into the chamber isolated by the bore 19 and the two lands 20. An external vent connection is shown at 30 and contains a dust device 33 which prevents dust from entering the vent connection and in turn connects to the vent bore 31.

Actually ports 21 and 22 are four flow slots 21*a* and 22*a* equally spaced in the bore 19 of the sleeve 17 as shown in the enlarged views of FIGS. 5, 5A and 5B which show the detail of slot 21*a* of FIG. 4. It is important that the unloaded actuator cylinder pressure be about one-half the valve inlet pressure to assure adequate actuator stiffness and loaded rate capability. To achieve this relationship with compressible flow, it is necessary that the vent orifice area be approximately twice the inlet orifice area, rather than the usual one:one ratio common to hydraulic flow spool valves. A unique feature of this compound pneumatic valve is the asymmetrical flow slots 21*a* and 22*a* to achieve the desired 2:1 oriface area ratio. Since the spool stroke is only 0.003 to 0.005 inches or about 5% of the width of the slots 21*a* and 22*a*, the asymmetrical slot allows inlet flow throttling across the smaller right side of the slot and vent flow across the larger left side of the slot. Typically, four such slots are located in the sleeve 17 opposite each of the two spool lands 20.

Connected to both distal ends of the valve spool 18 are face type solenoid armatures 32. The armature 32 consists of a stem portion 34 and a face portion 35 perpendicular to the stem and containing lightening holes 36 to minimize the mass of the armature. The armature 32 is fastened to the spool 18 by a suitable bonding agent, e.g., Locktite TM 609, available from Locktite Corporation, Newington, Conn. 06111. It is recommended that machine operations be selected which provide circumferential or circular striations to both mating surfaces of the spool and armature. The assembly is made so that the distal ends 38 of the spool 18 protrude beyond the face 35 of the armature 32.

The core assembly 39 consists of a helical wire coil 40 clad or jacketed with a magnetic core material which is in two parts, inner jacket 41 and outer jacket 42 with a gap at 44. One end of the core assembly 39 fits into the valve body 16 and is retained by a end cap 46 which is rectangular in cross section and bolts into the valve body to retain the core assembly by corner bolts, not shown. The armature 32 is oriented, in assembly, to the core assembly 39 so that air gaps occur at two places 45 and 45*a*. This arrangement increases the initial pull of the core assembly by establshing a path for the magnetic flux across the core and through the armature via the air gaps 45 and 45*a*. End cap 46 contains a threaded bore 48 on the longitudinal center line which contains an adjustable flow spool centering stop 49.

The flow spool centering stop 49 consists of a housing 50 which is threaded on the outside to match the threaded bore 48 in the end cap 46. Housing 50 has a through bore with a reduced diameter at one end so as to provide a shoulder 51 and an internal thread at the opposing end. Inside the housing 50 is a tappet 52 which engages shoulder 51 and a spring 55. Finally, a threaded plug 54 with a slot 53 and a shouldered end termination 56, which centers the spring, provides a preload adjustment on the spring 55 and forms a caged spring assembly. The flow spool centering stop 49 is adjustable via slot 57 so as to position the tappet 52 against the distal end 38 of the flow spool stem 18 and further provides an independent adjustment for the preload acting against the tappet 52 by adjusting plug 54. Thus, the flow spool centering stops function to lock the flow spool in the centered position in the absence of valve commands in any type of acceleration environment, provides the spool centering or restoring force in conjunction with the Bernoulli force, discussed above, to rapidly return the spool to the center position during solenoid drop-out and permits easy final valve adjustment without the need for precise tolerances.

Now, a source of high pressure gas is connected to the pressure port 29 (external connection not shown, but discussed) while first cylinder passage 25 and second cylinder passage 26 are connected to opposing cylinders of a balanced piston actuator. The left solenoid, as pictured, is energized, flow spool 18 moves to the left compressing the spring 55 in the flow centering stop 49. Spool 18 displacement allows the high pressure gas to flow to cylinder 1 while at the same time the gas from the second cylinder flows out second cylinder port 22 and through the vent 31 to the external vent 30. The exhaust gases, of course, cool the core assembly 39. When the solenoid is de-energized, the left and right adjustable flow spool centering stops 49 again center the flow spool, cover the flow ports 21 and 22 to shut off the flow of the gas. Since the total spool 18 displacement in either direction is 0.003 to 0.005 inches, the initial preloaded centering force provided by the spring 55 remains essentially constant and in the valve shown is approximately six pounds which combines with the inherent restoring force due to the axial component of the net change of momentum or Bernoulli effect which is two pounds in the valve shown. The combination provides eight pounds of restoring force at the energized position. This restoring force is small in relationship to the force provided by the solenoids so as to provide a very high response valve when combined with the time delayed current limitations and pulse width modulated solenoids, as previously discussed.

It should now be reasonably clear that with the inherently pressure balanced spool valve shown, the spool diameter, and hence horsepower capacity, can be doubled without significantly altering valve response using the same solenoids. This is possible because the solenoid air gap does not change with the doubling of horsepower. The increase in spool inertia contributed by the increase in diameter of the two spool lands 20 is small, because the large diameter portions of the armatures are the main contributors to the moving mass. The increased Bernoulli force which results from doubling the spool diameter is still only a small effect and can be readily accommodated by adjusting the preload spring force in the adjustable centering stops 49 to maintain the desired drop out time. The valve of this invention, particularly when combined with a balanced piston pneumatic actuator, provides a high product of frequency response and horsepower and is particularly appropriate for pneumatic actuation of tactical missile control systems.

Considering that the stroke of the spool 18 from the neutral or off position to full movement in one direction is only 0.003 to 0.005 inches, setting the air gap 45 between the armature 32 and the core assembly 39 is critical. It must be maintained within a few ten-thousanths of an inch while at the same time limiting the runout between the armature 32 and the core surface to a few ten-thousandths of an inch. These critical dimensions are maintained by counter-boring the diameter C in FIG. 8 on the same setup used to produce the spool sleeve bore 65 so as to maintain the shoulder surface A in the valve body (FIG. 8) on which the core assembly surface 47 bottoms perpendicular to spool motion.

Figure 8:
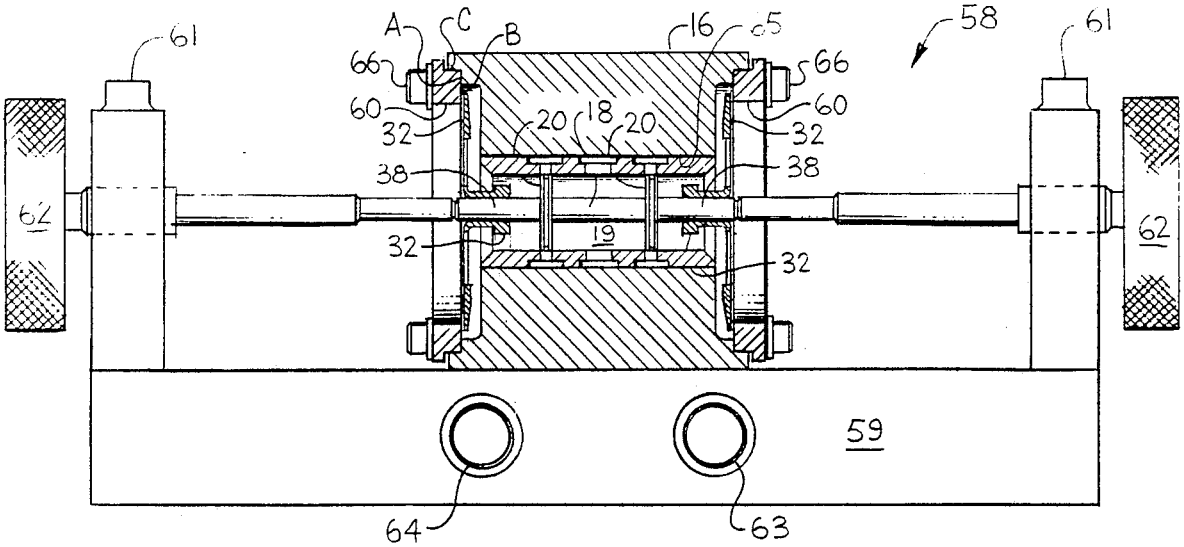
FIG. 8 is an adjustment fixture for locking the spool at center position and attaching the armatures.
Figure 9:
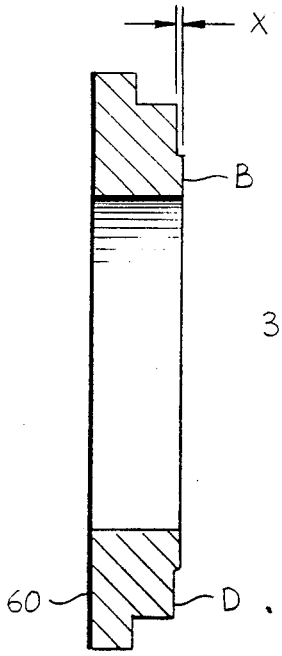
FIG. 9 is a detail of the fixture of FIG. 8.
Figure 10:
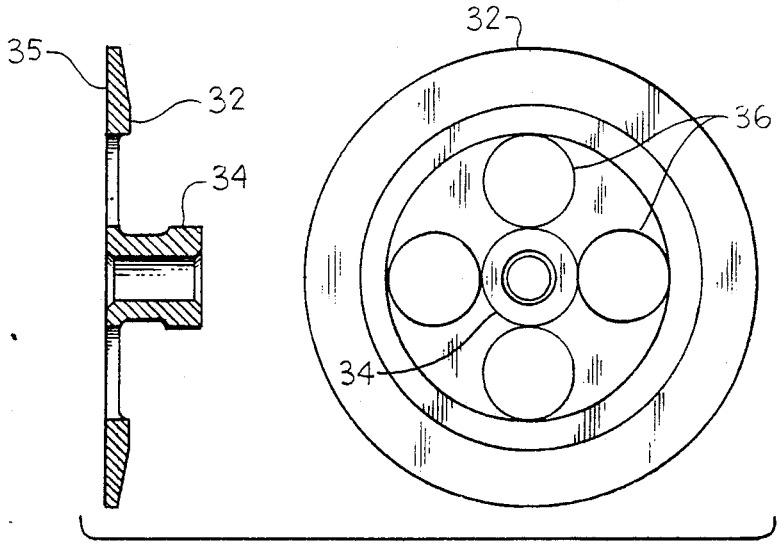
FIG. 10 is a detail of the armature which allows assembly with the fixture of FIG. 8.

The adjustment fixture shown in FIG. 8 is used to lock the spool in its centered position, based on flow measurements. That is, after attaching the valve body 16 to the fixture base, the spool 18 is inserted in the bore 19 after the spool lands 20 have been trimmed to exactly match the ports 21 and 22 in the valve body (FIG. 4). The armatures 32 are slipped on the ends 38 of the spool 18 along with the magnetic adapters 60. A low pressure gas source is then hooked up through a flow meter to the pressure port 29 of the valve body 16 and the spool 18 is positioned by the micrometer adjusters 61 by turning the thumbscrews 62 until the inlet gas flow is a minimum with a shunt connected between ports 63 and 64 which are in turn connected to cylinder passageways 25 and 26 (FIG. 4). This represents the neutral or off position of the valve, and the valve spool is locked in this position by the micrometer adjusters 61. Magnetic adapter plate 60 is then bolted to the valve body 16 with the fasteners 66 and, since it is magnetic, it holds the armature 32 against the surface B of the adapter 60. Since the dimension X (FIG. 9) is closely held to the proper tolerance on the adapter, it automatically presets the air gap as the adapter 60 surface D represents the core assembly 39. When the armatures 32 are indexed to the spool 18, a drop of Locktite 609 or equivalent is placed between the inner facing surfaces of distal end 38 of the spool 18 and the inside diameter of the armature 32 and allowed to "wick" into the joint. The assembly in the jig is then heated to 150° F. for two hours to cure the bonding agent. The armatures are now indexed to the flow spool with the solenoid stroke accurately set to the X dimension as shown on the adapter 60.

The compound pneumatic valve of this invention has been specifically designed for use with balanced piston pneumatic actuators and is particularly appropriate for pneumatic actuation of tactical missile control fins or nozzles requiring a high product of frequency response and horsepower.

What is claimed is:

1. A high power, compound, pneumatic, bang-bang, spool type valve with a closed center position and very fast opening and closing time, adapted to be electro mechanically driven by a pulse width modulated command signal, for driving a balanced piston actuator with high bandwidth comprising:

a valve body having a thru bore, a pressure inlet port, an external vent, and first and second cylinder ports formed by at least one asymmetrical slot,;

a valve spool slideably oriented in said valve body bore and having at least two enlarged first and second lands oriented to cover said first and second cylinder ports when said spool is in said center position and displacement of said spool in one direction connects said pressure port with said first cylinder port and said vent to said second cylinder port and displacement of said spool in the opposite direction connects said pressure port with said second cylinder port and said vent to said first cylinder port;

said asymmetrical slots forming said first and second cylinder ports oriented so that when said spool is displaced to vent said cylinder port, the area of said cylinder port is greater than the area of said cylinder port when said spool is displaced to connect said pressure port to said cylinder port;

first and second solenoids having a flat faced armature and a core assembly with said armatures attached to the respective ends of said spool and spaced from said core assembly;

means to bias said spool in said closed center position in the absence of said pulsed command signal, said biasing means applying essentially no force when said spool is in said closed center position and an essentially constant force with spool displacement so that said solenoids produce a force which when algebraically summed with all other forces acting on said spool produce a high net force authority which increases as the spool stroke increases so as to produce a fast opening and closing valve.

2. The pneumatic valve of claim 1 wherein said biasing means produces said essentially constant force which has a magnitude no greater than the force required to center said spool and to achieve a drop-out time less than 1 ms.

3. The pneumatic valve of claim 2 wherein said spool displacement from said closed center position to said full open position is nominally 0.003 to 0.005 inches.

4. The pneumatic valve of claim 3 wherein said pneumatic medium is vented over and around said core assembly of said solenoid.

5. The pneumatic valve of claim 4 wherein said means to bias said spool in said closed position is a caged spring with an externally adjustable pre-load.

6. The pneumatic valve of claim 5 wherein said first and second solenoid core assemblies contain an operating coil for moving said valve spool from full closed to full open in on-off fashion responsive to said pluse modulated command signal having connected thereto means for limiting the holding current of said operating coil following unlimited current during the initial pull-in phase whereby solenoid drop-out time is minimized along with coil average current and heating.

7. The pneumatic valve of claim 6 wherein said first and second solenoid core assemblies consist of a coil of wire jacketed with a magnetic core material with a break in said jacket opposite the outer diameter portion of said face type armature so as to provide a path for the magnetic flux across the core through the armature whereby the flux path is maintained at a large diameter removed from the longitudinal axes of said valve spool to minimize eddy current-carrying conductor area and maximizing conductor length, thus maximizing electrical resistance to induced currents and enhancing the rate of change of magnetic flux and pull-in and drop-out times of said solenoid.

8. The pneumatic valve of claim 7 further comprising means to drive said solenoids by varying the width of a high frequency electrical pulse to move said spool from closed to full open position and maintaining said full open position duration during each pulse width cycle proportional to said commanded flow, whereby establishing an essentially linear relationship between said commanded and actual flow, and wherein said means to drive said solenoids further comprises a period for the pulse width modulation frequency which is greater than the response time to move said valve spool from said closed to full open and from open to closed positions.

9. The pneumatic valve of claim 1 wherein said cylinder port asymmetrical slots are proportioned so that the area of said cylinder port when said spool is displaced to vent said cylinder port is two times the area of said cylinder port when said spool is displaced to connect said pressure port to said cylinder port.

10. A compound pneumatic, bang-bang, spool type, electro-mechanically driven valve, comprising:

a valve body having a thru bore, a pressure inlet port, an external vent, and first and second cylinder ports formed by at least one asymmetrical slot;

a valve spool slideably oriented in said valve body bore and having at least two enlarged first and second lands oriented to cover said first and second cylinder ports when said spool is in said center position and displacement of said spool in one direction connects said pressure port with said first cylinder port and said vent to said second cylinder port and displacement of said spool in the opposite direction connects said pressure port with said second cylinder port and said vent to said first cylinder port;

said asymmetrical slots forming said first and second cylinder ports oriented so that when said spool is displaced to vent said cylinder port, the area of said cylinder port is greater than the area of said cylinder port when said spool is displaced to connect said pressure port to said cylinder port;

first and second solenoids having a flat face type armature and a core assembly with said armature attached to the respective ends of said spool and spaced from said core assembly;

means to bias said spool in said closed center position in the absence of power to said solenoids, said biasing means applying essentially no force when said spool is in said closed center position and an essentially constant force with spool displacement so that said solenoids produce a force which when algebraically summed with all other forces acting on said spool produce a high net force authority which increases as the spool stroke increases so as to produce a fast opening and closing valve; and means to drive said solenoids by varying the width of a high frequency electrical pulse producing a period greater than the response time to move said spool from close to open and maintaining said open duration during each pulse width cycle proportional to said commanded flow and thereby establish a linear relationship between commanded signal and actual valve flow.

11. The pneumatic valve of claim 10 wherein the frequency of the pulse width modulated signal is in the 250 Hz range and the response time to move said valve spool from closed to full open and from open to closed is less than 1 ms.

* * * * *